United States Patent [19]

Aliev et al.

[11] 4,073,717

[45] Feb. 14, 1978

[54] PROCESS FOR PRODUCING GASOLINE

[76] Inventors: Vagab Safarovich Aliev, ulitsa Nizami, 66, kv. 40, Baku; Georgy Georgievich Markarian, Teply stan, 5 mikroraion, korpus 65, kv. 230, Moscow; Musa Ismail ogly Rustamov, ulitsa Gadzhibekova, 16, kv. 3; Evgeny Ivanovich Pryanikov, prospekt Kirova, 65, kv. 17, both of Baku, all of U.S.S.R.; Rustam Gadzhi Ali ogly Ismailova, deceased, late of Baku, U.S.S.R.; by Amina Kyazim Kyzy Ismailov, administrator, 1 Chkalovsky pereulok, 7, kv. 8, Baku, U.S.S.R.; by Ali Rustam ogly Ismailova, administrator, 1 Chkalovsky pereulok, 7, kv. 8, Baku, U.S.S.R.; by Dzhulietta Rustamovna Ismailova, administrator, 6 Kommunistichesky pereulok, 10, Baku, U.S.S.R.; by Zhanna Rustamovna Kulieva, administrator, Erevansky pereulok, 2, Baku, U.S.S.R.

[21] Appl. No.: 652,578

[22] Filed: Jan. 26, 1976

[51] Int. Cl.[2] ..... C10G 11/04; B01J 8/24; B01J 29/12

[52] U.S. Cl. ..... 208/74; 208/120; 208/164

[58] Field of Search ..... 208/74, 120

[56] References Cited

U.S. PATENT DOCUMENTS

| | | | |
|---|---|---|---|
| 2,710,279 | 6/1955 | Siecke | 208/155 |
| 2,767,126 | 10/1956 | Rice | 208/74 |
| 2,798,795 | 7/1957 | Rehbein et al. | 23/288 |
| 2,827,422 | 3/1958 | Rehbein | 208/164 X |
| 2,921,014 | 1/1960 | Marshall | 208/74 |
| 2,956,003 | 10/1960 | Marshall et al. | 208/74 |
| 3,188,184 | 6/1965 | Rice et al. | 23/288 |
| 3,188,185 | 6/1965 | Slyngstad et al. | 23/288 |
| 3,394,076 | 7/1968 | Bunn et al. | 208/164 |
| 3,433,733 | 3/1969 | Bunn et al. | 208/150 |
| 3,751,359 | 8/1973 | Bunn | 208/155 |

*Primary Examiner*—Delbert E. Gantz
*Assistant Examiner*—G. E. Schmitkons
*Attorney, Agent, or Firm*—Haseltine, Lake & Waters

[57] ABSTRACT

A process for producing gasoline which comprises cracking of a heavy petroleum feedstock in the presence of an alumino-silicate zeolite-containing catalyst maintained in a condition of an ascending flow at a temperature ranging from 480° to 520° C and a mass velocity of said feedstock of from 6 to 40 $hr^{-1}$ in the direction of said ascending flow with the formation of a reaction mixture containing gasoline, a fraction with a specific gravity of from 0.75 to 0.85 and a fraction with a specific gravity of from 0.85 to 0.95; the resulting reaction mixture is isolated from the catalyst and subjected to separation; said separated fractions are employed as recycle. The fraction with a specific gravity of from 0.75 to 0.85 is subjected to cracking in the presence of said catalyst which is in a condition of an ascending flow at a temperature of from 460° to 520° C and a mass velocity of said fraction of from 6 to 40 $hr^{-1}$ in the direction of said ascending flow. As a result of said cracking a reaction mixture is formed containing gasoline. The reaction mixture is separated from the catalyst and gasoline is recovered therefrom; the fraction with a specific gravity of from 0.85 to 0.95 is subjected to cracking in the presence of said catalyst which is in a condition of an ascending flow at a temperature of from 460° to 520° C and at a mass velocity of this fraction selected within the range of from 5 to 8 $hr^{-1}$ with the formation of a reaction mixture containing gasoline and a fraction with a specific gravity of 0.85 to 0.95; said latter reaction mixture is combined with the reaction mixture obtained from said cracking of a heavy petroleum feedstock and delivered, after separation from the catalyst, to the recovery of gasoline.

2 Claims, 1 Drawing Figure

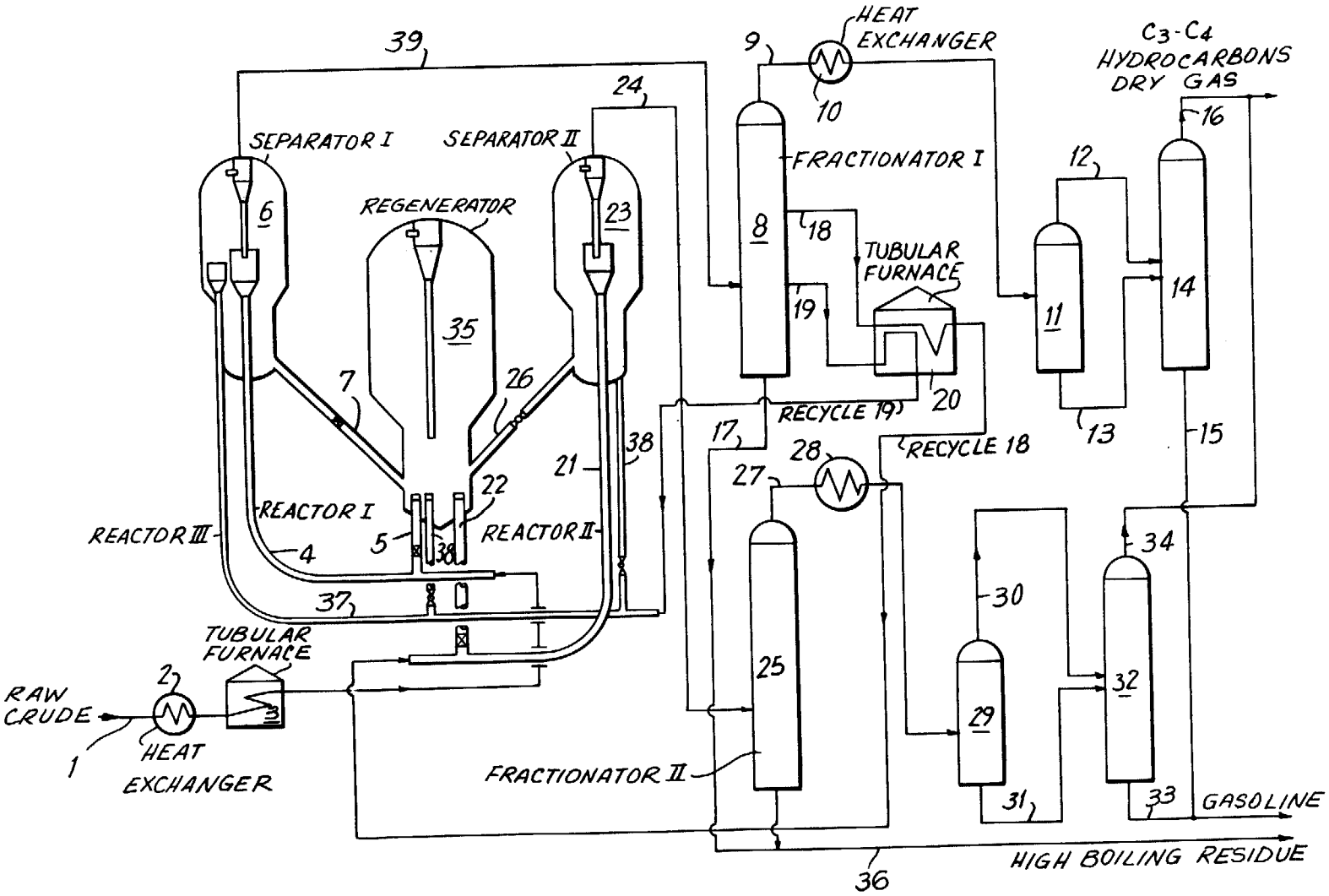
C3-C4 HYDROCARBONS DRY GAS
GASOLINE
HIGH BOILING RESIDUE
HEAT EXCHANGER
FRACTIONATOR I
TUBULAR FURNACE
RECYCLE 18
RECYCLE 19
FRACTIONATOR II
SEPARATOR II
SEPARATOR I
REGENERATOR
REACTOR II
REACTOR I
REACTOR III
TUBULAR FURNACE
HEAT EXCHANGER
RAW CRUDE

PROCESS FOR PRODUCING GASOLINE

BACKGROUND OF THE INVENTION

The present invention relates to processes for producing gasoline.

Gasoline is extensively used in the car industry.

Known in the art are some processes for producing gasolines by catalytic cracking of a heavy petroleum feedstock such as bunker fuel, gas oil, vacuum distillate using an amorphous or zeolite-containing aluminosilicate catalyst, followed by regeneration of the coked catalyst and recycle of the regenerated catalyst to the cracking stage. Produced from such cracking is a reaction mixture containing gasoline which is then separated from the reaction mixture by rectification (cf. C. W. Strouther, Oil and Gas Journal, 1972, v. 70, No. 2, pp. 102–104, 106–110; Hydrocarbon Processing, 1972, v. 51, No. 9; Hydrocarbon Processing, 1968, v. 47, No. 9, p. 148).

Gasolines produced by these prior art processes have an octane number, as it is, of 79 – 82 points by the motor-method and 89 – 93 by the research method. In some cases, depending on the starting stock quality, gasolines may be produced with an octane number per se of up to 84 points by the motor-method and as high as 96 by the research method.

Said prior art processes have, however, a disadvantage residing in the fact that the gasolines produced cannot be used, individually, as top grade automobile gasolines. To be used for this purpose, they should be compounded with tetraethyl lead and a high-octane component.

Also known in the art is a process for producing gasoline by catalytic cracking of a heavy petroleum feedstock (cf. U.S. Pat. No. 3,394,076 and U.S. Pat. No. 3,448,037).

In this process, a heavy petroleum feedstock such as a straight-run gas oil is subjected to cracking in the presence of a regenerated zeolite-containing aluminosilicate catalyst which is in a state of an ascending flow (first reaction stream) at a temperature of, for example, from 471° to 524° C and at a space-mass velocity of the feed of 40 to 65 $hr^{-1}$. The reaction products along with the coked catalyst are delivered to a settling zone of the reactor, wherein the reaction products are separated from the coked catalyst.

The reaction products contain a fraction with a specific gravity of from 0.75 to 0.95 which incorporates gasoline, and a recycled fraction boiling above 221° C which are recovered by rectification.

The separated recycled fraction is again subjected to catalytic cracking in the presence of said catalyst which is in a state of an ascending flow (second reaction stream) at a temperature of from 485° to 537° C at a mass-space velocity of the recycled fraction of 40 to 65 $hr^{-1}$. The reaction products containing gasoline along with the coked catalyst are delivered to the same settling zone of the reactor, wherein the reaction products resulting from cracking of the first reaction stream are separated.

In the settling zone the reaction products are compounded, separated from the coked catalyst and delivered to separation, while the coked catalyst is fed as a combined stream to the regeneration.

This process results in 65 vol.% of gasoline with the final boiling point of 221° C which corresponds to a yield of 45 wt. % with the final boiling point of 195° C.

This prior art process has a disadvantage residing in that the resulting gasoline, as is, has an insufficient octane number, i.e. 80.1 points by the motor method and 92.5 points by the research method.

The resulting gasoline may be used as a top grade commercial gasoline only after addition of tetraethyl lead and high-octane components. However, ethylated gasoline produced by this method causes atmospheric pollution with lead compounds entrained with exhausted gases.

Another disadvantage of this prior art process resides in that the second reaction stream — the fraction with a high final boiling point facilitates, under the cracking conditions, an extensive coke-formation and hinders the controlled conversion of reactive hydrocarbons.

Still another disadvantage of this prior art process resides in the fact that cracking in both reaction streams is effected at high weight velocities of the feedstock and, hence at low concentrations of the catalyst which does not make it possible to obtain gasoline with the required high chemical stability without adding oxidation inhibitors.

Furthermore, due to the fact that the reaction products of both reaction streams are compounded prior to the separation of gasoline and recycled fraction, the latter fraction which is a feedstock for the second reaction stream is enriched with aromatic hydrocarbons owing to secondary reactions. This results in a higher coke deposition rate on the catalyst and in impaired quality of the resulting gasoline.

SUMMARY OF THE INVENTION

It is an object of the present invention to provide a process for producing gasoline which would make it possible to obtain a top grade gasoline with a high yield.

This and other objects of the present invention are accomplished by the process for producing gasolines by cracking a heavy petroleum feedstock in the presence of an aluminosilicate zeolite-containing catalyst which is in a condition of an ascending flow at a temperature of from 480° to 520° C and at a mass velocity of said feedstock ranging from 6 to 40 $hr^{-1}$ in the direction of said ascending flow with the formation of a reaction mixture containing gasoline, a fraction with a specific gravity of from 0.75 to 0.85 and a fraction with a specific gravity of from 0.85 to 0.95; the resulting reaction mixture is isolated from the catalyst and subjected to separation; the fraction with a specific gravity of from 0.75 to 0.85 is subjected to cracking in the presence of said catalyst which is in a condition of an ascending flow at a temperature ranging from 460° to 520° C and at a mass velocity of said fraction of from 6 to 40 $hr^{-1}$ in the direction of said ascending flow with the formation of a reaction mixture containing gasoline; this reaction mixture is separated from the catalyst and gasoline is recovered therefrom; the fraction with a specific gravity of from 0.85 to 0.95 is subjected to cracking in the presence of said catalyst which is in a condition of an ascending flow at a temperature ranging from 460° to 520° C at a mass velocity of said fraction selected within the range of from 5 to 8 $hr^{-1}$ with the formation of a reaction mixture containing gasoline and a fraction with a specific gravity of 0.85 to 0.95; the latter reaction mixture is compounded with the reaction mixture obtained from cracking of said heavy petroleum feedstock and, after separating from the catalyst, is delivered to the recovery of gasoline.

BRIEF DESCRIPTION OF THE DRAWING

The drawing is a schematic diagram of the process of the invention.

DETAILED DESCRIPTION OF THE INVENTION

Due to the fact that cracking of a heavy petroleum feedstock and said fractions is effected at a diminishing mass velocity of the feedstock movement, concentration of the catalyst is increased in the direction of the feedstock stream. This technique makes it possible to perform, within the zone of a high catalyst concentration, conversion of unsaturated hydrocarbons produced in the zone of a low catalyst concentration so that as a result of this conversion aromatic and isoparaffin hydrocarbons are mainly formed due to the reaction of hydrogen disproportioning, dehydrocyclization and isomerization.

Separation of the recycled fraction into a fraction with a specific gravity of from 0.75 to 0.85 and a fraction with a specific gravity of from 0.85 to 0.95 with subsequent individual cracking makes it possible to effect cracking of the 0.75 - 0.85 fraction on the surface of the catalyst non-blocked with aromatic hydrocarbons being present in the 0.85 - 0.95 fraction, i.e. to perform cracking under conditions of lesser coke content on the catalyst.

The process of the present invention makes it possible to obtain a top grade gasoline with a high yield of the order of 37.9 to 48.0% by weight.

Gasoline produced by the process according to the present invention comprises a commercial product. It has an octane number in the pure form of 87 - 88 points by the motor method and 95 - 96 points in the pure form by the research method, as well as a high chemical stability, i.e. it does not require addition of tetraethyl lead polluting the atmosphere as well as other components contributing to an improved chemical stability of gasoline.

Standard equipment and apparatus including, for example, a reactor, regenerator, pipe stills, rectification column, and heat exchangers are used.

The starting feedstock (along line 1) such as bunker fuel or vacuum distillate is heated in heat exchangers 2 to a temperature of 180° C and then in pipe stills 3 to some 380°-400° C to be fed thereafter to the first reactor 4. The same reactor is charged with an alumosilicate zeolite-containing catalyst delivered from a regenerator 35 and having a temperature of from 600° to 670° C (along line 5).

The starting feedstock and the catalyst are moved along the reactor by an upward flow at a mass velocity of the feedstock of 6 to 40 $hr^{-1}$ in the direction of the flow at a temperature within the range of 480° to 520° C. Concentration of the catalyst varies from 20 to 250 $kg/m^3$. Under these conditions cracking of the heavy petroleum feedstock is effected. The reaction products resulting from said cracking and containing gasoline, a dry gas consisting of $H_2$, $CH_4$, and $C_2$, a $C_3$-$C_4$ hydrocarbon, a fraction with a specific gravity of 0.75 to 0.85, a fraction with a specific gravity of 0.85 to 0.95, and a residue are passed into a settling section 6 of the first reactor 4 wherein separation of the reaction mixture from the coked catalyst is effected; said catalyst is then fed to regeneration (along line 7). Thereafter, the reaction mixture is passed into the first reactification column 8 for separation. Vapor-phase products are withdrawn from the column top along line 9 and passed, after condensation and cooling 10, to a gas-separator 11 wherein gaseous products are separated from the liquid phase. Further, gaseous and liquid products are passed to stabilization 14 along lines 12 and 13, resulting in a stable gasoline 15, dry gas containing $H_2$, $CH_4$, and $C_2$, and $C_3$-$C_4$hydrocarbons 16. High-boiling residue is discharged from the bottom of the rectification column 8 (along line 17).

Also discharged from the column 8 are two side distillates one of which comprises a fraction with a specific weight of 0.75 to 0.85 (along line 18) and the other — a fraction with a specific gravity of 0.85 to 0.95 (along line 19).

The fraction with a specific gravity of 0.75 to 0.85 (along line 18), after heating in a pipe still 20 to a temperature of 250° to 300° C, is delivered to the bottom section of the second reactor 21 whereinto a regenerated aluminosilicate zeolite-containing catalyst heated to 600° to 700° C is fed (along line 22) from said regenerator 35. This fraction with the catalyst also forms an ascending flow. Mass velocity of said fraction varies from 6 to 40 $hr^{-1}$ in the direction of the flow. Catalyst concentration in the stream varies from 20 to 275 $kg/m^3$ accordingly, the temperature being maintained within a range of 460° to 520° C. Under these conditions cracking of said fraction is effected as well. The reaction products containing gasoline, dry gas consisting of $H_2$, $CH_4$ and $C_2$, and $C_3$-$C_4$ hydrocarbons and a heavy residue are passed into the settling section of the reactor 23 wherein they are separated from the coked catalyst and delivered to rectification (along line 24) to the second rectification column 25. The coked catalyst is also fed for regeneration 35 along line 26. Vapor-phase reaction products are discharged (along line 27) from the column 25 top and, after condensation and cooling 28, are delivered to a gas-separator 29 wherein the gaseous products are separated from the light phase.

After the separation, the gaseous and liquid products are delivered to stabilization 32 which results in a stabilized gasoline (along line 33), dry gas containing $H_2$, $CH_4$ and $C_2$, and $C_3$-$C_4$ hydrocarbons (along line 34). Each of these products is compounded with similar products resulting from the first stabilization 14.

A high-boiling residue is discharged from the rectification column 25 in its bottom section and mixed with the high-boiling residue from line 17 of the first column 8 and is discharged from the plant (along line 36).

The fraction with a specific gravity of 0.85 to 0.95 (along line 19) resulting from cracking of the starting heavy petroleum feedstock is delivered from the first rectification column 8 to a furnace 20 wherein it is preheated to a temperature of 350°-400° C, whereafter it is delivered to the third reactor 37. Fed into the same reactor is the catalyst delivered from the regenerator at a temperature of 600° to 670° C (along line 38).

Said fraction and the catalyst are in a condition of an ascending flow. Mass velocity of the fraction is maintained constant and selected within a range of 5 to 8 $hr^{-1}$. The catalyst concentration is 200 to 300 $kg/m^3$. The reaction mixture formed under these conditions contains gasoline, dry gas consisting of $H_2$, $CH_4$ and $C_2$, and $C_3$-$C_4$ hydrocarbons, a fraction with a specific gravity of 0.75 to 0.85, a fraction with a specific gravity of 0.85 to 0.95 and a heavy residue. Said fraction may be subjected to cracking under the same conditions and on a coked catalyst fed from the second reactor 23 along line 38.

The resulting reaction mixture is fed, along with the catalyst, to the settling section of the first reactor 6 wherein it is compounded with the reaction mixture and the coked catalyst resulting from cracking of the starting heavy petroleum feedstock. After separation from the catalyst, the reaction mixture is fed, as a combined stream, to the first rectification column 8 along line 39 for separation.

As has been stated hereinabove, gasoline separated from the first and the second rectification columns is delivered to stabilization. Products resulting from the stabilization are used in a certain manner.

Dry gas is used, for example, as fuel.

Hydrocarbons $C_3$, $C_4$ may be used, for example, as starting feed for chemical processes.

The heavy residue discharged directly from the first and second rectification columns may be used, for example, as fuel oil in carbon black production.

For better understanding of the present invention some specific examples are given hereinbelow.

EXAMPLE 1

Gasoline is produced by cracking of bunker fuel (mazout) in the presence of a zeolite-containing aluminosilicate catalyst. The bunker fuel has the following characteristics:

| | |
|---|---|
| Density, $\rho_4^{20}$ | 0.9159 |
| fractions: | |
| initial boiling point | 308° C |
| boils up to 350° C | 9.3 vol. % |
| boils up to 400° C | 21.4 vol. % |
| boils up to 500° C | 55.4 vol. % |
| boils 500° C | 44.6 vol. % |
| coking capacity | 3.4 wt. % |
| ash content | 0.06 wt. % |
| Brenken flash point | 170° C |

The aluminosilicate zeolite-containing catalyst has the following characteristics:

| | |
|---|---|
| Activity | 48 points |
| Bulk weight | 0.761 |

Chemical composition, percent by weight:

| | |
|---|---|
| $Al_2O_3$ | 11.8 |
| $SiO_2$ | 83.43 |
| $Fe_2O_3$ | 0.32 |
| CaO | 0.9 |
| $Na_2O$ | 0.35 |
| Rare-earth elements | 3.2 |

The bunker fuel and aluminosilicate zeolite-containing catalyst are brought into contact by the ascending flow in the reactor at the temperature of 480° C and at a diminishing mass velocity of bunker fuel in the direction of the ascending flow of from 30 to 6 $hr^{-1}$. Concentration of the catalyst in the flow is increased from 40 to 250 $kg/m^3$.

As a result of said cracking, a reaction mixture is obtained consisting of gasoline, dry gas, hydrocarbons $C_3$-$C_4$, a fraction with a specific gravity of from 0.75 to 0.85, a fraction with a specific gravity of from 0.85 to 0.95 and a heavy residue. This reaction mixture along with the coked catalyst is fed to the settling section of the reactor, wherein it is separated from the coked catalyst. The latter is delivered to regeneration, while the reaction mixture is fed to a rectification column for separation.

Upon rectification, the fraction with a specific gravity of from 0.75 to 0.85 is delivered to the second reactor, wherein it is contacted with the regenerated catalyst in an ascending flow at the temperature of 520° C at a diminishing mass velocity of said fraction ranging from 40 to 10 $hr^{-1}$. Concentration of the catalyst in said flow is increased from 20 to 175 $kg/m^3$. As a result of cracking of said fraction a reaction mixture is obtained containing gasoline, dry gas, $C_3$-$C_4$ hydrocarbons and a heavy residue. The resulting reaction mixture along with the coked catalyst is delivered to the settling zone of the reactor 2, wherein it is separated from the catalyst and fed to the second rectification column 2 for separation.

The fraction with a specific gravity of from 0.85 to 0.95 resulting from cracking of bunker fuel is contacted, in the third reactor, with the catalyst (coked or regenerated) in an ascending flow at the temperature of 520° C at a mass velocity of the fraction being cracked of 8 $hr^{-1}$. Concentration of the catalyst is 200 $kg/m^3$ in the direction of the flow. A reaction mixture is obtained consisting of gasoline, a dry gas, hydrocarbons $C_3$ and $C_4$, a fraction with a specific gravity of not more than 0.85 and a fraction of a specific gravity of from 0.85 to 0.95 as well as a heavy residue. This reaction mixture along with the coked catalyst is compounded in the settling section of reactor 1 with the reaction mixture and coked catalyst obtained from cracking of said bunker fuel, followed by separation of the compounded reaction mixture from the coked catalyst. The latter is delivered to regeneration, while the compounded reaction mixture is fed to rectification column 1 for rectification.

Gasolines obtained in rectification columns 1 and 2 are subjected to stabilization. The yield of gasoline is 38.5%.

The resulting gasoline has the following characteristics:

| | |
|---|---|
| Density, $\rho_4^{20}$ | 0.790 |
| Fractions: | |
| Initial boiling point | 42° C |
| 10% boils at | 70° C |
| 50% boils at | 115° C |
| 90% boils at | 164° C |
| Final boiling point | 195° C |
| Octane number in the pure form by the motor method | 87.4 points |
| Octane number in the pure form by the research method | 95 points |

EXAMPLE 2

Gasoline is obtained as in Example 1, except that cracking of bunker fuel in the first reactor is effected at the temperature of 500° C, at a mass velocity of bunker fuel of from 35 to 8 $hr^{-1}$ and concentration of the catalyst of from 30 to 200 $kg/m^3$. In the second reactor cracking of the fraction with a specific gravity of 0.75 to 0.85 is effected at the temperature of 490° C at a mass velocity of the fraction of from 35 to 8 $hr^{-1}$ and the catalyst concentration of from 30 to 200 $kg/m^3$. In the third reactor cracking of the fraction with a specific gravity of from 0.85 to 0.95 is effected at the temperature of 490° C, at the mass velocity of the fraction of 7 $hr^{-1}$ and the catalyst concentration of 250 $kg/m^3$. The yield of gasoline is 40.3% by weight.

The gasoline has the following characteristics:

| | |
|---|---|
| Density, $\rho_4^{20}$ | 0.785 |
| Fractions: | |
| Initial boiling point | 42° C |
| 10% boils at | 71° C |
| 50% boils at | 116° C |
| 90% boils at | 164° C |
| Final boiling point | 195° C |
| Octane number in the pure form by the motor method | 87.5 points |
| Octane number in the pure form by the research method | 95.5 points |

EXAMPLE 3

Gasoline is obtained in a manner similar to that described in Example 1, except that cracking of bunker fuel in the first reactor is effected at the temperature of 520° C, mass velocity of bunker fuel of from 40 to 10 $hr^{-1}$ and the catalyst concentration of from 20 to 100 $kg/m^3$. In the second reactor cracking of the fraction with a specific gravity of from 0.75 to 0.85 is effected at the temperature of 460° C, mass velocity of the fraction of from 30 to 6 $hr^{-1}$ and the catalyst concentration of from 40 to 275 $kg/m^3$. In the third reactor cracking of the fraction with a specific gravity of from 0.85 to 0.95 is effected at the temperature of 460° C, mass velocity of the fraction of 5 $hr^{-1}$ and the catalyst concentration of 300 $kg/m^3$. The yield of gasoline is 37.9%.

The gasoline has the following characteristics:

| | |
|---|---|
| Density, $\rho_4^{20}$ | 0.78 |
| Fractions: | |
| Initial boiling point | 42° C |
| 10% boils at | 72° C |
| 50 wt. % boils at | 118° C |
| 90 wt. % boils at | 164° C |
| Final boiling point | 195° C |
| Octane number in the pure form by the motor method | 88 points |
| Octane number in the pure form by the research method | 96 points. |

EXAMPLE 4

Gasoline is obtained as in Example 1, except that as the starting feedstock use is made of a vacuum distillate with the following characteristics:

| | |
|---|---|
| Boiling range | 350 to 500° C |
| Density $\rho_4^{20}$ | 0.89 |
| Coking capacity | 0.01 |
| Brenken flash point | 195° C |
| Ash content | 0.06 wt. % |
| Kinematic viscosity at 50° C | 24 cSt |
| Kinematic viscosity at 100° C | 14 cSt. |

The yield of gasoline is 45.3% by weight. The gasoline characteristics are similar to those described in Example 1.

EXAMPLE 5

Gasoline is obtained under conditions of Example 2 using as the starting feedstock the vacuum distillate with the characteristics given in Example 4. The yield of gasoline is 48.0% by weight. The gasoline characteristics are similar to those of Example 2.

EXAMPLE 6

Gasoline is obtained under conditions of Example 3 using as the starting feedstock the vacuum distillate of Example 4. The yield of gasoline is 45.2 wt.%. The gasoline characteristics are similar to those of Example 3.

What is claimed is:

1. A process for producing gasoline which comprises cracking a heavy petroleum feedstock in the presence of alumino-silicate zeolite-containing catalyst which is in a condition of an ascending flow at a temperature ranging from 480° to 520° C and at a mass velocity of said feedstock of from 6 to 40 $hr^{-1}$ in the direction of said ascending flow with the formation of a first reaction mixture containing gasoline, a fraction with a specific gravity of from 0.75 to 0.85 and a fraction with a specific gravity of from 0.85 to 0.95; separating said first reaction mixture from the catalyst and separating from said first reaction mixture a fraction A with a specific gravity of from 0.75 to 0.85 and a fraction B with a specific gravity of from 0.85 to 0.95; cracking said fraction A in the presence of said catalyst which is in a condition of an ascending flow at a temperature of from 460° to 520° C and at a mass velocity of said fraction A of from 6 to 40 $hr^{-1}$ in the direction of said ascending flow with the formation of a second reaction mixture containing gasoline; separating said second reaction mixture from the catalyst; recovering gasoline from said second reaction mixture; cracking said fraction B in the presence of said catalyst which is in a condition of an ascending flow at a temperature of from 460° to 520° C and at a mass velocity of said fraction B selected within the range of from 5 to 8 $hr^{-1}$ with the formation of a third reaction mixture containing gasoline and a fraction C with a specific gravity of from 0.85 to 0.95; and combining fraction C with said first reaction mixture; whereby concentration of the catalyst is increased in the direction of the feedstock stream, due to effecting cracking at a diminishing mass velocity of the feedstock stream.

2. The process of claim 1 wherein the catalyst concentration during the cracking of the feedstock is 20 to 250 $kg/m^3$, during the cracking of fraction A is 20 to 275 $kg/m^3$ and during the cracking of fraction B is 200 to 300 $kg/m^3$.

* * * * *